US007183521B2

(12) United States Patent
Fisher

(10) Patent No.: US 7,183,521 B2
(45) Date of Patent: Feb. 27, 2007

(54) RACK SENSOR

(75) Inventor: Gary Fisher, Goodlettsville, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 147 days.

(21) Appl. No.: 11/087,311

(22) Filed: Mar. 23, 2005

(65) Prior Publication Data

US 2005/0217499 A1 Oct. 6, 2005

Related U.S. Application Data

(60) Provisional application No. 60/558,272, filed on Mar. 31, 2004.

(51) Int. Cl.

| | |
|---|---|
| ***F24C 7/08*** | (2006.01) |
| ***F24C 16/16*** | (2006.01) |
| ***A21B 1/40*** | (2006.01) |
| ***A21B 1/50*** | (2006.01) |

(52) U.S. Cl. ..... 219/413; 219/392; 219/393; 126/333; 126/337 R

(58) Field of Classification Search ..... None
See application file for complete search history.

(56) References Cited

U.S. PATENT DOCUMENTS

| | | | | |
|---|---|---|---|---|
| 4,254,325 | A * | 3/1981 | Snyder | 219/413 |
| 5,111,028 | A | 5/1992 | Lee | |
| 5,220,153 | A | 6/1993 | Malone et al. | |
| 5,534,680 | A | 7/1996 | Kadwell et al. | |
| 5,618,458 | A * | 4/1997 | Thomas | 219/394 |
| 6,727,478 | B2 | 4/2004 | Rael et al. | |
| 6,730,880 | B2 | 5/2004 | Smith et al. | |
| 6,815,644 | B1 * | 11/2004 | Muegge et al. | 219/393 |
| 7,064,296 | B1 * | 6/2006 | Harned et al. | 219/391 |

* cited by examiner

*Primary Examiner*—Joseph Pelham
(74) *Attorney, Agent, or Firm*—Pearne & Gordon LLP

(57) ABSTRACT

An oven having a cooking cavity and a removable rack structure has a rack sensor in the oven. The sensor provides an indication of an absence or presence of the structure and an oven control permits oven cleaning in response to the indication of the absence of the structure or prevents oven cleaning in response to the indication of the presence of the structure.

8 Claims, 2 Drawing Sheets

RACK SENSOR

CROSS REFERENCE TO RELATED APPLICATIONS

This application claims the benefit of U.S. Provisional Patent Application No. 60/558,272, filed on Mar. 31, 2004, and entitled RACK SENSOR.

BACKGROUND OF THE INVENTION

1) Field of the Invention

The present invention relates to racks for appliances, and more particularly, to a sensing device in an oven rack.

2) Description of Prior Art

Typically, cooking appliances designed for household uses are provided with one or more racks for supporting food items to be cooked within an oven cavity. The oven cavity itself is generally provided with sidewall rails for supporting respective lateral sides of the rack, while permitting the rack to be vertically adjusted. That is, the rack can slide along a selected set of support rails for movement into and out of the oven cavity, with the rack also being removable for cleaning or for repositioning at a different height.

Oven racks are often of wire construction. More specifically, an outer wire frame and a support platform, which is constituted by a plurality of fore-to-aft and laterally spaced wires, define a typical oven rack. The wires are substantially evenly spaced across the entire rack for use in supporting food items to be cooked.

The racks and the sidewall rails all may be removable for ease of cleaning outside of the oven and to protect both the appearance and the glides of the rack structure during an oven self-cleaning (pyrolysis). Unfortunately, users tend to leave the structure in place. The presence of the rack structure in the oven during a cleaning cycle results in discoloration of the rack structure and degradation of the glide system.

SUMMARY OF THE INVENTION

I accordance with one aspect, the present invention provides a oven having a cooking cavity and a removable rack structure that has a rack sensor in the oven. The sensor provides an indication of an absence or presence of the structure and an oven control permits oven cleaning in response to the indication of the absence of the structure or prevents oven cleaning in response to the indication of the presence of the structure.

DESCRIPTION OF THE EXAMPLE EMBODIMENT

It is to be appreciated that the various drawings are not drawn to scale from one figure to another nor inside a given figure, and in particular that the size of the components are arbitrarily drawn for facilitating the reading of the drawings.

In the following description, for purposes of explanation, numerous specific details are set forth in order to provide a thorough understanding of the present invention. It may be evident, however, that the present invention may be practiced without these specific details.

Figure 1:
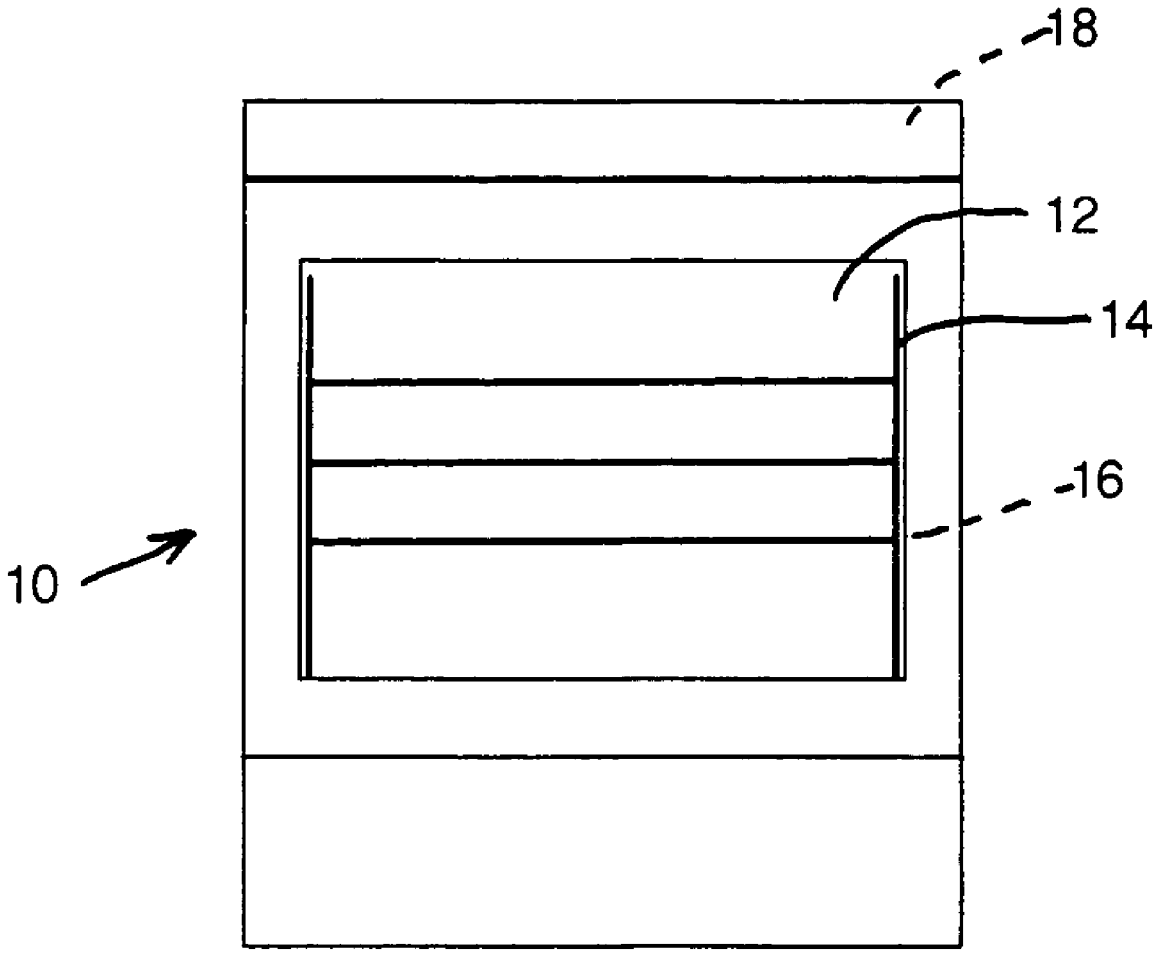
FIG. 1 is an example front elevation view of an oven according to the invention shown without a front door for clarity.
Figure 2:
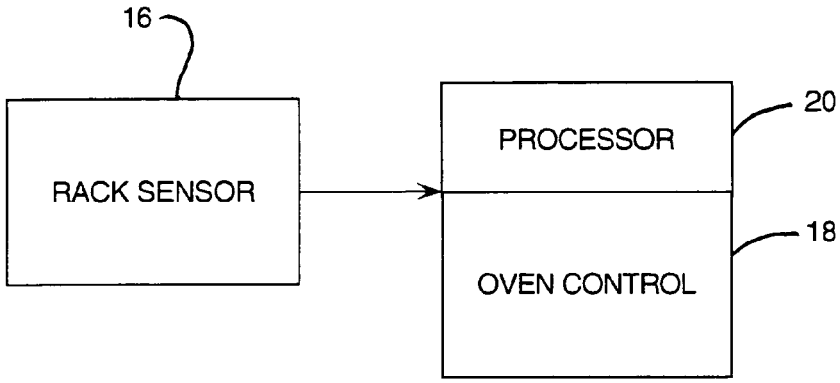
FIG. 2 is a block diagram of an oven according to the invention.

Referring to FIGS. 1 and 2, an oven 10 includes a cooking cavity 12 and a rack structure 14. Within the oven 10 is a rack sensor 16 that is connected to an oven control 18. The oven control 18 may advantageously include a microprocessor 20.

The rack sensor 16 may be any suitable sensor such as, for example, a mechanical switch located at any suitable position to sense the presence or absence of the rack structure. Other possible sensors may be, for example, optical switches, magnetic switches, proximity switches, and ultrasonic switches as well as applications where the rack structure itself completes a circuit. One possible implementation is for a portion of the rack structure to protrude through an aperture in the cooking cavity whenever the rack structure is in the cavity. The protruding portion can then mechanically operate a switch that is advantageously located external to the cavity. The switch is thus protected from oven heat.

When the rack structure 14 is removed from or placed in the oven 10, the sensor 16 can send a change of state signal to the processor 20 on the oven control 18, which can either enable or disable a clean operation depending upon the information received. It should be noted that this control architecture is merely an example, the function being provided may be implemented in many configurations.

Figure 3:
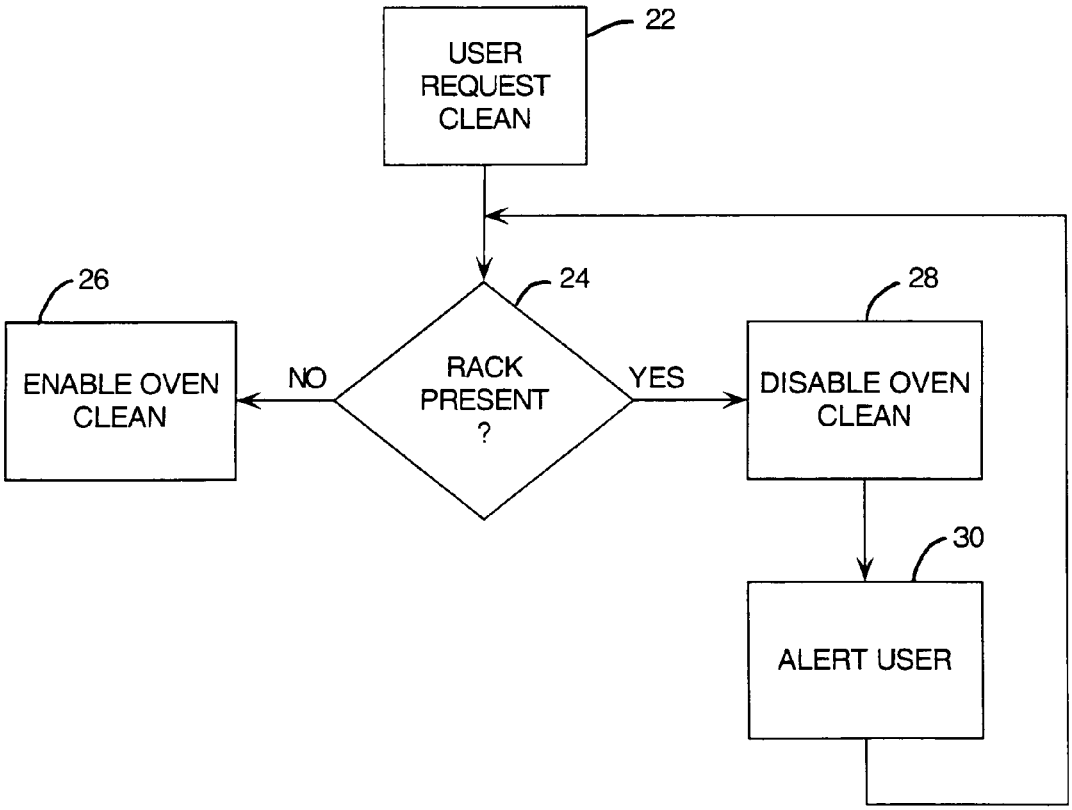
FIG. 3 is a block diagram of an additional aspect of an oven according to the invention.

Referring to FIG. 3, an example of the operation of the oven 10 according to the invention includes a user 22 requesting an oven cleaning cycle. Based on the indication provided by the sensor 16, a decision 24 is made as to whether a rack structure is present in the oven 10. If the result is no, an oven cleaning is permitted 26. If the result is yes, the oven cleaning is prevented 28. In addition, when a rack structure being present prevents cleaning, an alert 30 is provided to signal the user to take corrective action before a cleaning cycle will run (the operation loops back to 22).

The alert may be, for example, a visual signal, an audible signal or both.

It should be noted that more than one rack structure may be present in the oven, in which case it would be desirable to sense the presence or absence of each structure that should be removed during cleaning. This would of course remain within the scope of the invention.

The present invention facilitates continuous proper operation of a rack glide system. The sensor interacts with the racks to enable or disable the cleaning operation depending upon whether the racks are present within the oven.

What has been described above includes example implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations of the present invention.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An oven having a cooking cavity and a removable rack structure for said cooking cavity, said oven comprising:

a rack sensor in said oven, said sensor providing indication of an absence or presence of said structure; and an oven control, said control permitting oven cleaning in response to the indication of the absence of said structure or preventing oven cleaning in response to the indication of the presence of said structure.

2. An oven according to claim 1, further comprising a user alert, said alert being activated by said control in response to the indication of the presence of said structure.

3. An oven according to claim 2, wherein said alert is audible.

4. An oven according to claim 2, wherein said alert is visual.

5. A method for cleaning an oven, said method comprising:

requesting an oven cleaning operation;

sensing an absence or presence of a removable rack structure in said oven;

permitting oven cleaning in response to the absence of said structure or preventing oven cleaning in response to the presence of said structure.

6. A method according to claim 5, further comprising alerting a user to the presence of said structure.

7. A method according to claim 6, wherein said alerting is by an audible alert.

8. A method according to claim 6, wherein said alerting is by a visual alert.

* * * * *